United States Patent [19]

Ciavarra

[11] Patent Number: 5,060,591

[45] Date of Patent: Oct. 29, 1991

[54] SAILBOAT

[76] Inventor: Richard Ciavarra, 4511 Tyrone Ave., Sherman Oaks, Calif. 91423

[21] Appl. No.: 512,327

[22] Filed: Apr. 23, 1990

[51] Int. Cl.[5] ..... B63B 43/14

[52] U.S. Cl. ..... 114/123; 114/39.1; 114/61; 114/125

[58] Field of Search ..... 114/123, 125, 140, 39.1, 114/61

[56] References Cited

U.S. PATENT DOCUMENTS

| | | | |
|---|---|---|---|
| 744,590 | 11/1903 | Moore | 114/39.1 |
| 1,709,219 | 4/1929 | Hille | 114/39.1 |
| 3,137,263 | 6/1964 | Sainte-Claire | 114/125 |
| 3,161,170 | 12/1964 | Latham | 114/39.1 |
| 4,217,845 | 8/1980 | Hood et al. | 114/125 |
| 4,441,445 | 4/1984 | DeWeck | 114/123 |

*Primary Examiner*—Sherman Basinger
*Assistant Examiner*—Thomas J. Brahan
*Attorney, Agent, or Firm*—Julius L. Rubinstein

[57] ABSTRACT

The sailboat is provided with an outwardly projecting outrigger which is built like a container and is buoyant. Valve controlled openings are constructed in the outrigger below the water line so a controlled amount of water can enter the outrigger and serve as ballast to make the outrigger heavier so it acts like an adjustable lateral keel. A motor controlled air pump is on the boat and connected to the outrigger by air lines. In this way operation of the air pump drives the water out of the controlled openings to lighten the boat.

1 Claim, 2 Drawing Sheets

SAILBOAT

This invention relates to a sail boat having an outrigger, which is small in size, strong, and light.

PRIOR ART AND BRIEF SUMMARY

Sailboats with outriggers are quite common, as exemplified by the patents to Bailey U.S. Pat. No. 3,870,o04. Garber U.S. Pat. No. 3,777,690, Cook, U.S. Pat. No. 4,061,099, and Rineman. These outriggers help stabilize the sailboat and help prevent capsizing. Some, as exemplified by the patent to Cook use the weight of the passengers as a ballast in addition to the weight of the passenger carrying boat. The weight of the boat with the passengers is supported by the buoyancy of the outrigger thus preventing the boat from being capsized. The patent to Garber discloses a simple canoe with an outrigger attached for safety. It is noted that the sail is the Garber patent is mounted in the outrigger. The patent to Bailey also discloses a canoe like boat with an outrigger, but in this case the outrigger is provided with a keel.

However, none of these patents are concerned with the problem applicant has solved. Boats are expensive, and the longer the boat, the more it costs. There is a need therefore for a small sailboat which is light, inexpensive and stable for ease of transport, ease of launching, and the ability to sail in very shallow water.

However shortening a sail boat tends to make it unstable, particularly in a stiff wind. To avoid this an outrigger is provided. But when a sailboat is small in length, the conventional outrigger does not provide enough weight to keep the boat Stable in strong winds.

Applicant has solved this problem by providing means for varying the weight of the outrigger in accordance with need as determined by the strength of the wind. To do this he uses the outrigger as a combination outrigger and a buoyant tank and provides the outrigger with controlled openings below the water line, to let a controlled quantity of water inside the outrigger when he wants to increase the weight of the outrigger, and an air pump to push the water out, when conditions permit a light outrigger. Conventional valves (not shown), controlled by the operator of the boat are attached to the openings to close or partially close the size of the openings to control or stop the flow of water inside the outrigger.

What is needed therefore and comprises an important object of this invention is to provide a small sailboat which is light and with an outrigger attached to it for stability.

Another object of this invention is to provide a shallow draft sailboat with a lateral keel or outrigger which has means for letting water inside the outrigger or driving it out in accordance with wind conditions.

Another object of this invention is to provide a sailboat with a hollow keel having conventional internal baffles wherein water can be let in or pumped out of the keel, and with baffles mounted in the keel preventing water in the keel from surging and affecting the performance of the sail boat.

These and other objects of this invention will become more apparent when better understood in the light of the accompanying specification and drawing wherein FIG. 1 is an elevational view of the sailboat showing the sailboat with the outrigger attached.

Figure 1:
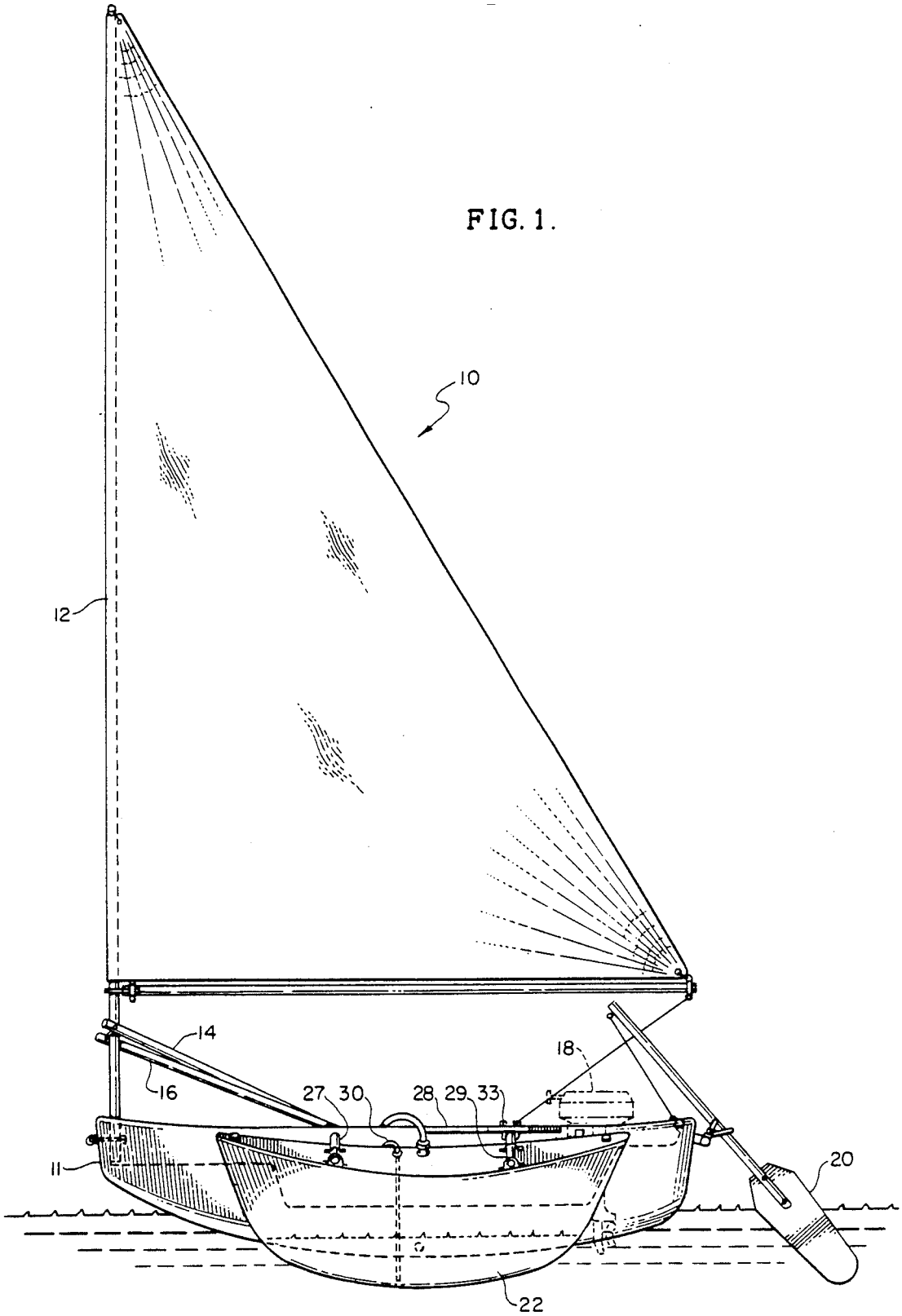

Referring now to FIG. 1 of the drawing a sail boat indicated generally by the reference numeral 10 comprising a mast 12, mast support struts 14 and 16, attached to the mast, an outboard motor 18, a rudder 20, and an outwardly projecting outrigger 22.

Figure 2:
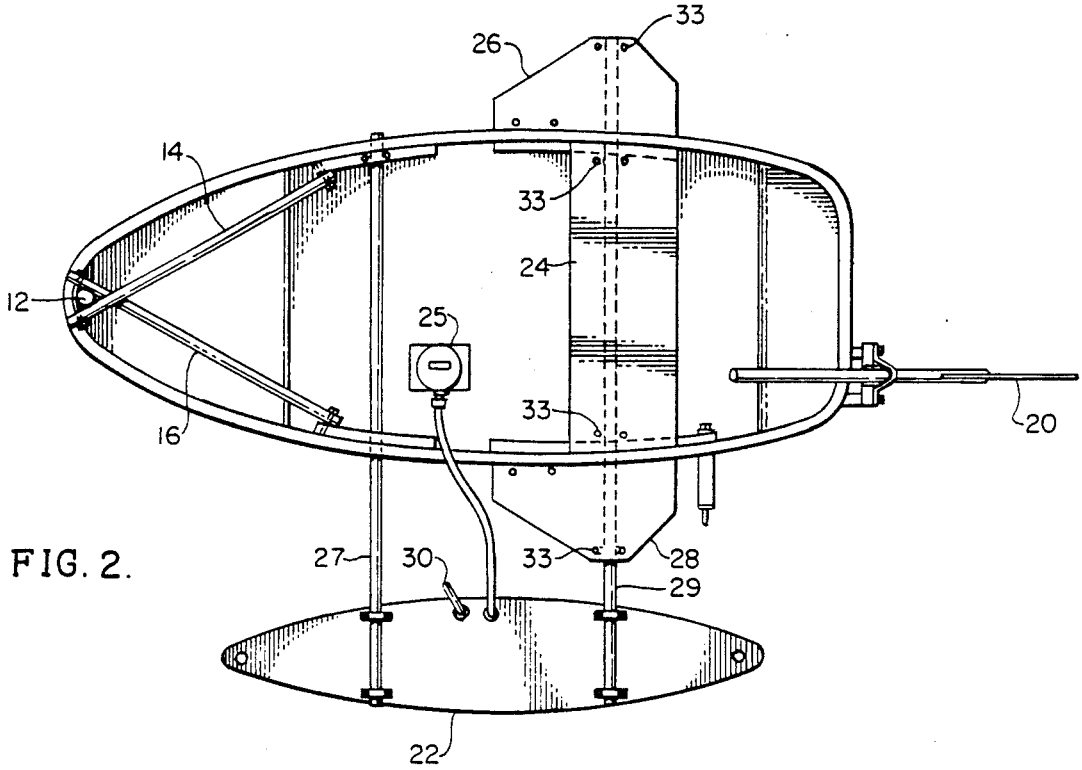
FIG. 2 is a plan view of the sail boat discloses the boat and the outrigger, and disclosing the comparatively large width of the sailboat in comparison to its length.
Figure 3:
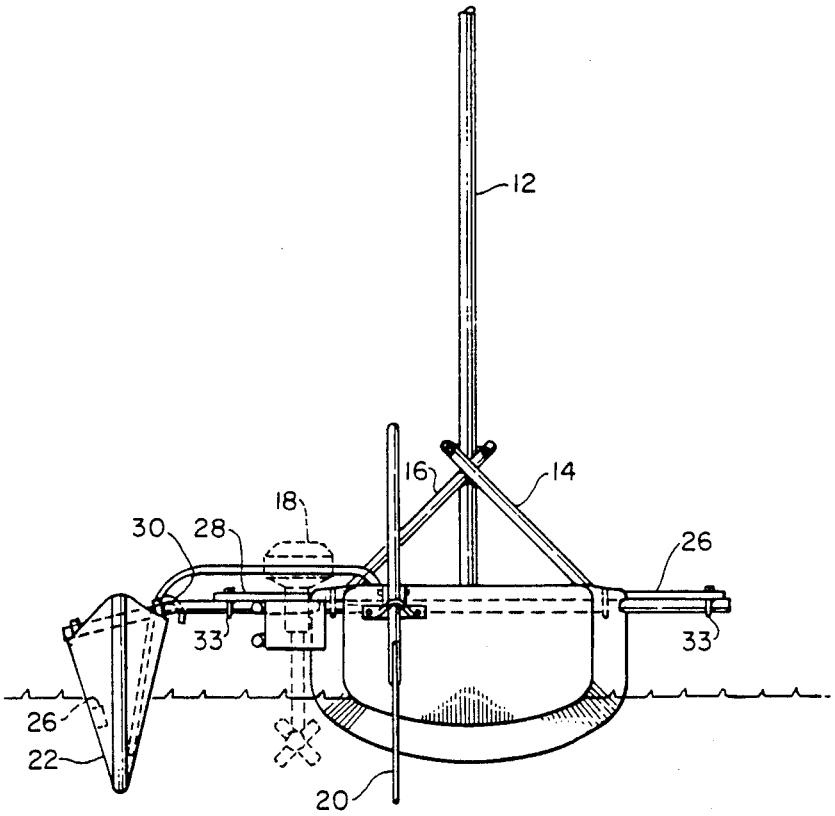
FIG. 3 is a rear elevational view of the sailboat, showing its curved bottom, the rear view of the outrigger, the mast, an outboard motor and a pump.

FIG. 2 discloses a seat 24 for the boat and the seat extends beyond the sides of the boat at 26 and 28 so that passengers or the pilot of the boat if he is alone, when necessary can sit on these seats 26 and 28 and help stabilize the boat according to need. The outrigger 22 could be formed from a buoyant material or be hollow as will be described below.

A pump 24 is mounted in the boat and this pump is powered by the outboard motor. The outrigger 22 is hollow and it is provided with one or more electrically operated valve controlled openings 26 below the water line of the outrigger. If the wind is too strong and it appears that the outrigger may be lifted out of the water, and the boat capsized, the pilot actuates these valve controlled openings 26 letting water in the outrigger to increase the weight of the outrigger. If the wind dies down, the pilot closes the openings 28 and operates pump 24. Pump 24 is connected to the outrigger by air hoses 30 pumping the water out of the outrigger and lightening it in accordance with wind conditions.

It is noted in FIG. 1 that the boat 10 and the outrigger 22 have shallow drafts. This means that the boat can be sailed almost to shore which is an advantage if it is desired to land on for a while.

It is noted that the boat is round bottomed for greater speed when sailing and for stability.

Having described the invention what I claim as new is:

1. A sail boat which is small in length and wide in the beam, having a passenger compartment and an attached outrigger, a mast mounted on the sail boat for holding a sail, said mast mounted on the extreme front of said boat, a sail supported by the mast, said outrigger in the form of buoyant tank, means for admitting and expelling water from the outrigger, said means comprising valve controlled openings beneath the water line of the outrigger to permit a controllable quantity of water to flow inside the outrigger to increase the weight of the outrigger under proper wind conditions, a motor mounted in the boat, a propeller mounted in the boat below the water line, said motor connected to said propeller to drive the sailboat when there is no wind, an air pump mounted in said boat, said motor connected to said pump to operate it, air lines connected from said pump to said outrigger to increase the pressure inside said outrigger to drive the water therein out through said openings, whereby the outrigger can be lightened under suitable wind conditions.

* * * * *